US009302799B2

(12) United States Patent
Mortensen

(10) Patent No.: US 9,302,799 B2
(45) Date of Patent: Apr. 5, 2016

(54) METHOD FOR BULK TRANSPORTING 2,6-XYLENOL SUSCEPTIBLE TO OXIDATIVE DISCOLORATION

(75) Inventor: Eric Mortensen, Latham, NY (US)

(73) Assignee: SABIC Global Technologies B.V., Bergen Op Zoom (NL)

( * ) Notice: Subject to any disclaimer, the term of this patent is extended or adjusted under 35 U.S.C. 154(b) by 1223 days.

(21) Appl. No.: 13/081,606

(22) Filed: Apr. 7, 2011

(65) Prior Publication Data

US 2011/0182675 A1 Jul. 28, 2011

Related U.S. Application Data

(60) Provisional application No. 61/460,744, filed on Feb. 17, 2011.

(51) Int. Cl.

| | |
|---|---|
| ***B65B 31/02*** | (2006.01) |
| ***B65B 63/08*** | (2006.01) |
| ***B65D 81/20*** | (2006.01) |
| ***B65B 31/00*** | (2006.01) |

(52) U.S. Cl.

CPC ..... *B65B 31/02* (2013.01); *B65B 31/00* (2013.01); *B65D 81/2053* (2013.01); *B65D 81/2076* (2013.01); *B65B 63/08* (2013.01); *B65D 81/2069* (2013.01)

(58) Field of Classification Search

CPC ..... B65D 81/2084; B65D 81/2076; B65D 81/2069; B65D 81/2053; B65B 37/14; B65B 37/06; B65B 3/14; B65B 3/12; B65B 3/10; B65B 63/08; B65B 31/00; B65B 31/02

USPC ..... 53/400, 432, 440, 510, 127

See application file for complete search history.

(56) References Cited

U.S. PATENT DOCUMENTS

| | | | | |
|---|---|---|---|---|
| 3,946,534 | A * | 3/1976 | Egly | 53/432 |
| 4,376,489 | A * | 3/1983 | Clemens | 220/1.5 |
| 4,487,959 | A * | 12/1984 | Dickerson | 560/248 |
| 4,528,799 | A * | 7/1985 | Olsen | 53/432 |
| 5,064,070 | A | 11/1991 | Higashiyama | |
| 5,489,037 | A * | 2/1996 | Stopper | 220/1.5 |
| 6,109,052 | A * | 8/2000 | Austin, Jr. | 62/259.1 |
| 6,508,378 | B1 * | 1/2003 | Maeda et al. | 220/560.07 |
| 6,605,667 | B1 | 8/2003 | Badejo et al. | |
| 6,938,654 | B2 * | 9/2005 | Gershtein et al. | 141/231 |
| 8,827,313 | B2 * | 9/2014 | Haut et al. | 280/839 |
| 8,863,479 | B2 * | 10/2014 | Olschimke | 53/432 |
| 2003/0120006 | A1 * | 6/2003 | Bell et al. | 526/161 |
| 2003/0164201 | A1 * | 9/2003 | Kopp | 141/9 |
| 2006/0151354 | A1 | 7/2006 | Dombroski et al. | |
| 2007/0163910 | A1 * | 7/2007 | Bonnette et al. | 206/459.1 |
| 2008/0234446 | A1 * | 9/2008 | Heilek et al. | 526/68 |
| 2008/0293912 | A1 * | 11/2008 | Jernigan | 528/279 |
| 2010/0056739 | A1 * | 3/2010 | Funk et al. | 526/317.1 |
| 2010/0187151 | A1 | 7/2010 | Sato | |
| 2011/0036059 | A1 * | 2/2011 | Dey | 53/432 |
| 2012/0261299 | A1 * | 10/2012 | Fussnegger | 206/524.1 |

FOREIGN PATENT DOCUMENTS

| | | | | |
|---|---|---|---|---|
| CN | 1756635 | A | 4/2006 | |
| DE | 3912153 | C1 * | 8/1990 | B65B 31/00 |
| DE | 102004053474 | * | 6/2005 | B65B 3/10 |
| DE | 102004053474 | A1 * | 6/2005 | B65B 3/10 |
| GB | 2086834 | A * | 5/1982 | B65B 31/00 |
| JP | 56087525 | A * | 7/1981 | 114/74 R |
| WO | 0069749 | | 11/2000 | |
| WO | WO 0069749 | A1 | 11/2000 | |
| WO | 2008116840 | | 10/2008 | |

OTHER PUBLICATIONS

International Search Report for PCT/US2011/031905, mailed Feb. 24, 2012, 3 pp.

* cited by examiner

*Primary Examiner* — Stephen F Gerrity

(74) *Attorney, Agent, or Firm* — Honigman Miller Schwartz and Cohn LLP; Heidi M. Berven

(57) ABSTRACT

This application is directed to a method for minimizing oxidative discoloration of a chemical compound such as a monomer during shipping, storing, and/or aging.

29 Claims, No Drawings

METHOD FOR BULK TRANSPORTING 2,6-XYLENOL SUSCEPTIBLE TO OXIDATIVE DISCOLORATION

CROSS-REFERENCE TO RELATED APPLICATIONS

This application claims the benefit of U.S. provisional patent application Ser. No. 61/460,744, filed Feb. 17, 2011, which is hereby incorporated by reference.

BACKGROUND OF THE INVENTION

This application is directed to a method for minimizing oxidative discoloration of a chemical compound such as a monomer during shipping, storing, and/or aging. "Oxidative discoloration" refers to the discoloration of a chemical compound or other material due to exposure to an oxidant. In this particular case, the oxidant is oxygen as found in air. The discoloration of chemical compounds and other materials due to storage and/or exposure to air has been observed and mechanistic explanations for the process are available. In addition, the degree of yellowing can be quantified according to available methods, which include visual comparison against known standards, such as provided by the APHA yellow color index. For example, upon shipping, storing, and/or aging under ambient conditions (that is, in air), the monomer 2,6-dimethyl phenol (CAS Reg. No. 576-26-1 ("2,6-xylenol"), which is generally white or colorless, discolors to a yellow color, rendering it less desirable for further processing. Thus, there is a need for a method that minimizes discoloration of a monomer during shipping, storing, and/or aging.

SUMMARY OF EMBODIMENTS OF THE INVENTION

These and other needs are met by the present invention, which is directed to a method for minimizing exposure of a monomer to ambient oxygen during shipping storing, and/or aging and thus to a method for minimizing monomer discoloration. In the method, a bulk shipping container that is suitable for transporting a monomer is flushed with a non-oxidative gas prior to monomer loading. The monomer is then loaded into the bulk shipping container, optionally under a positive pressure of a non-oxidative gas. Finally, the bulk shipping container loaded with the monomer is sealed under a positive pressure of a non-oxidative gas. The method is disclosed for 2,6-xylenol, but can be equally applicable to the shipping, storing, and/or aging of 2,6-xylenol analogues or other monomers such as alkylated phenols susceptible discoloration. Since 2,6-xylenol is typically a solid at ambient temperature, the method also comprises heating the 2,6-xylenol to above its melting point to facilitate loading and off-loading. The process of heating the monomer may also be conducted under a positive pressure of a non-oxidative gas.

Thus, in one embodiment, the invention is directed to a method for bulk transporting a monomer susceptible to oxidative discoloration, comprising:

(a) loading the monomer to a bulk shipping container; and
(b) sealing the bulk shipping container loaded with the monomer under a positive pressure of the non-oxidative gas.

In another embodiment, the invention is directed to a method for bulk transporting 2,6-xylenol, comprising:

(a) loading the monomer to a bulk shipping container; and (b) sealing the bulk shipping container loaded with the monomer under a positive pressure of the non-oxidative gas.

In another embodiment, the invention provides a method for bulk transporting a monomer susceptible to oxidative discoloration, comprising:

(a) purging a bulk shipping container with a non-oxidative gas;
(b) loading the monomer to the bulk shipping container; and
(c) sealing the bulk shipping container loaded with the monomer under a positive pressure of the non-oxidative gas.

In a further embodiment, the invention provides a method for bulk transporting 2,6-xylenol, comprising:

(a) purging a bulk shipping container with a non-oxidative gas;
(b) loading the monomer to the bulk shipping container; and
(c) sealing the bulk shipping container loaded with the monomer under a positive pressure of the non-oxidative gas.

In another embodiment, the invention provides a method for bulk transporting 2,6-xylenol that minimizes formation of colored degradation products, comprising:

(a) purging a bulk shipping container with a non-oxidative gas;
(b) loading the 2,6-xylenol to the bulk shipping container; and
(c) sealing the bulk shipping container loaded with the 2,6-xylenol under a positive pressure of the non-oxidative gas.

In another embodiment, the invention provides a method for bulk transporting 2,6-xylenol that maintains the APHA to 100 APHA or less, comprising:

(a) purging a bulk shipping container with an inert gas;
(b) loading the 2,6-xylenol to the bulk shipping container; and
(c) sealing the bulk shipping container loaded with the 2,6-xylenol under a positive pressure of the inert gas.

In another embodiment, the invention provides a method for off-loading an air-sensitive monomer susceptible to discoloration from a bulk shipping container, comprising:

(a) providing a positive pressure of a non-oxidative gas to the interior of the bulk shipping container;
(b) adjusting the temperature of the bulk shipping container to maintain the flowability of the monomer; and
(c) transferring the monomer to a receiving container under a positive pressure of the non-oxidative gas.

In another embodiment, the invention provides a container comprising a pressurizable interior, wherein the interior is under a positive pressure of a non-oxidative gas, and wherein the container further comprises a monomer susceptible to oxidative discoloration and an optional antioxidant.

In another embodiment, the invention provides a method for bulk transporting a monomer susceptible to oxidative discoloration from a first to a second location, comprising:

(a) loading the monomer to the interior of a bulk shipping container;
(b) sealing the bulk shipping container loaded with the monomer under a positive pressure of the non-oxidative gas;
(c) transporting the bulk shipping container from the first to the second location, while maintaining a positive pressure of the non-oxidative gas in the interior compartment of the shipping container during transporting to the second location; and (d) off-loading the monomer susceptible to oxidative discoloration at the second location to a receiving tank under a positive pressure of a non-oxidative gas In another embodiment, the invention provides a method for off-loading an air-sensitive monomer susceptible to discoloration from a bulk shipping container, comprising:

(a) maintaining a positive pressure of an inert gas to the interior of the bulk shipping container;
(b) adjusting the temperature of the bulk shipping container to melt the monomer;
(c) transferring the melted monomer to a receiving container under a positive pressure of the non-oxidative gas.

DETAILED DESCRIPTION OF EMBODIMENTS OF THE INVENTION

The inventors found that discoloration was minimized during the loading, transporting, and off-loading process when a monomer such as 2,6-xylenol was shipped, stored, and/or aged under a positive pressure of a non-oxidative gas. "Non-oxidative gas" means a gas that does not typically act as an oxidant, such as, for instance, helium, argon, or nitrogen, or the like.

Thus, as indicated above, in one embodiment, the invention provides a method for bulk transporting a monomer susceptible to oxidative discoloration, comprising:

(a) loading the monomer to a bulk shipping container; and
(b) sealing the bulk shipping container loaded with the monomer under a positive pressure of the non-oxidative gas.

In the method, the monomer can be any monomer susceptible to oxidative discoloration, such as 2,6-xylenol or the like. Typically, the monomer is ready for further use, and thus contains a minimum amount of impurities. Typically, when 2,6-xylenol is the monomer, the purity is greater than 99.0 percent and more typically, the purity of the 2,6-xylenol is greater than 99.8 percent and contains no more than 0.5% maximum percent of water and no more that 0.16 percent by weight of other aromatic components, which may include other phenols and cresols. Typically, the APHA color number of the 2,6-xylenol prior to loading is no more than 100, and preferably the APHA color number is no more than 75. More preferably, the APHA color number is no more than 50. Most preferably, the APHA color number is no more than 25.

The method involves the transfer of the monomer from one location, which may be a storage tank, to another location, which may be a shipping container, and ultimately, to another location which may be a receiving tank at an industrial processing facility or the like. Thus, the bulk shipping container is typically a container designed for transportation of chemicals and conforms to International Organization for Standardization (ISO) specifications for the shipment of chemicals. Optionally, the container is equipped with a permanent or removable pressure monitoring device and an oxygen detector and/or an oxygen concentration detector. Such devices are widely and commercially available.

As indicated, the container must be capable of maintaining a positive pressure, and a positive pressure of a non-oxidative gas is optionally maintained during the loading process. In the method, the gas that is used is a non-oxidative gas that will not facilitate discoloration of the monomer. The non-oxidative gas is selected from the group consisting of nitrogen, helium, neon, and argon, or mixtures thereof. More preferably, the non-oxidative gas is nitrogen or argon, or mixtures thereof.

In the method, the container is typically "purged" with the non-oxidative gas prior to on-loading of the monomer to replace the air/oxygen from the container with the non-oxidative gas. The process of purging, which includes flushing and/or rinsing, is accomplished by providing a stream of non-oxidative gas through the container by means of gas inlet and outlet valves that can be opened and closed. The gas inlet and outlet valves are opened to allow for the stream of non-oxidative gas to pass through the container, thus removing any ambient air from the container and replacing it with the non-oxidative gas. The purging process is continued for a time sufficient so that the container becomes essentially free of oxygen; that is, so that the oxygen concentration in the container interior is between about 0.01 percent and 10 percent.

It is possible to further ensure that oxidative discoloration of the monomer is minimized by employing an antioxidant, and the present invention includes optionally adding an antioxidant to the container prior to loading the monomer. The preferred antioxidant is an organophosphite antioxidant, and more preferably, the antioxidant is bis(2,4-di-t-butylphenyl) pentraerythritol diphosphite (Ultranox® 626) used alone or in combination with other antioxidants.

After confirming that the container is sufficiently free of oxygen and optionally adding an antioxidant, the monomer is transferred to the container. Unless otherwise specified, the process of loading the monomer to the bulk shipping container is optionally conducted under a positive pressure of a non-oxidative gas. The monomer must be sufficiently flowable to facilitate transferring it into the container. 2,6-Xylenol is typically a solid at ambient temperature, and must be melted, and is thus heated to above its melting temperature of approximately 45° C., in order to transfer it to the container. This monomer is typically loaded into the bulk shipping container at a temperature above 50° C., but typically below 100° C. Typically the temperature for loading and offloading the monomer is in the range of about 60° C. to 90° C., and is typically between about 65° C. to 85° C. This temperature is maintained throughout the on-loading and off-loading process. When the loading process is complete, the loaded container is pressurized with the non-oxidative gas prior to sealing, to produce a positive pressure of about 1 to about 20 psig of the non-oxidative gas.

The skilled artisan will recognize that as the monomer cools and solidifies, the pressure in the container will drop. Thus, it is important to sufficiently pressurize the container to prevent leak-in of ambient air into the sealed container. The "sufficient pressure" will depend on various factors, including the ambient temperature and pressure as well as the time that it takes to transport the monomer from one location to another, but generally, a positive pressure of about 1 to about 20 psig of the non-oxidative gas will suffice.

Once filled and pressurized with the non-oxidative gas, the sealed container can be used to store the monomer prior to use, or to transport the monomer from one location to another location. The monomer can then be off-loaded, for instance, at a manufacturing facility, to a storage tank or the like, optionally under a positive pressure of a non-oxidative gas within the temperature ranges provided above.

The invention also provides a method for bulk transporting 2,6-xylenol, comprising:

(a) loading the monomer to a bulk shipping container;
(b) sealing the bulk shipping container loaded with the monomer under a positive pressure of the non-oxidative gas; and
(c) transporting the loaded container.

In one embodiment, a positive pressure of a non-oxidative gas is maintained in the container during loading. Thus, the container is purged with the non-oxidative gas as described above, such as nitrogen and then an optional antioxidant such as Ultranox is added to the container. Next, the monomer is loaded into the container, optionally while maintaining a positive flow of nitrogen through the container. As indicated previously, when 2,6 xylenol is the monomer, it is necessary to perform the loading process at above the melting temperature of 2,6-xylenol to facilitate the flow of the monomer into the container. After the loading process is complete, the container is pressurized with the non-oxidative gas and then sealed. As the container temperature drops and the 2,6-xylenol solidifies, the interior pressure of the container will drop. Thus, as indicated, it is important to pressurize the container as needed to prevent air from leaking in as the 2,6-xylenol cools. Typically the pressure needed to prevent "air leak in" into the container is in the range of 1 to 20 psig, but varies according to various factors such as ambient pressure and temperature, and the time required to transport the monomer.

In another embodiment, the invention requires an initial purging step to remove air from the container. This embodiment provides a method for bulk transporting a monomer susceptible to oxidative discoloration, comprising:

(a) purging a bulk shipping container with a non-oxidative gas;

(b) loading the monomer to the bulk shipping container while optionally maintaining a positive pressure of a non-oxidative gas; and (c) sealing the bulk shipping container loaded with the monomer under a positive pressure of the non-oxidative gas.

As in the previous embodiments, the monomer may be any monomer susceptible to oxidative discoloration, including but not limited to 2,6 xylenol, and the non-oxidative gas is nitrogen or argon. Here, the container is optionally equipped with a pressure measuring device and/or an oxygen detector or a means for attaching a pressure measuring device and/or an oxygen detector. Purging is continued for a time sufficient so that the container is essentially free of oxygen, or contains less than 0.01 to 10 percent oxygen by weight. An organophosphite antioxidant such as Ultranox® 626 may optionally be added to the container. The monomer is added to the container at a temperature sufficient to maintain its flowability, which, in the instance of 2,6-xylenol is above its melting point temperature, or from about 50° C. to about 100° C. Typically the temperature for loading and offloading the monomer is in the range of about 60° C. to 90° C. The temperature is maintained throughout the transfer process.

When the loading process is complete, the loaded container is pressurized with the non-oxidative gas prior to sealing, to produce a positive pressure of about 1 to about 20 psig of the non-oxidative gas.

In a specific embodiment, the invention provides a method for bulk transporting 2,6-xylenol, comprising:

(a) purging a bulk shipping container with a non-oxidative gas which is nitrogen;

(b) loading the monomer to the bulk shipping container; and (c) sealing the bulk shipping container loaded with the monomer under a positive pressure of the nitrogen of about 5 to about 20 psig In another specific embodiment, the invention provides a method for bulk transporting 2,6-xylenol, comprising:

(a) purging a bulk shipping container with nitrogen;

(b) loading the 2,6-xylenol to the bulk shipping container; and (c) sealing the bulk shipping container loaded with the 2,6-xylenol under a positive pressure of nitrogen of about 5 to about 20 psig; and (d) transporting the loaded container.

In another specific embodiment, the invention provides a method for bulk transporting 2,6-xylenol that minimizes discoloration of the 2,6-xylenol, comprising:

(a) purging a bulk shipping container with a non-oxidative gas such as nitrogen or as defined herein;

(b) loading the 2,6-xylenol which has an initial APHA of 100 or less to the bulk shipping container; and (c) sealing the bulk shipping container loaded with the 2,6-xylenol under a positive pressure of the non-oxidative gas.

In this embodiment, the APHA of the 2,6-xylenol remains at 100 APHA or less. More preferably, the APHA of the 2,6-xylenol remains at 75 APHA or less. More preferably, the APHA of the 2,6-xylenol remains at 50 APHA or less. More preferably, the APHA of the 2,6-xylenol remains at 25 or less. If the 2,6-xylenol discolors relative to its initial color, the change in APHA is preferably less than 100 APHA units, and more preferably less than 50 APHA units, and more preferably, less than 25 APHA units.

In a further embodiment, the invention provides a method for bulk transporting a monomer susceptible to oxidative discoloration from a first to a second location, comprising:

(a) loading an optional antioxidant such as Ultranox® 626 and a monomer such as 2,6-xylenol heated to above its melting temperature to the interior of a bulk shipping container as described herein;

(b) sealing the bulk shipping container loaded with the monomer under a positive pressure of the non-oxidative gas of about 5 to about 20 psig and then transporting the bulk shipping container;

(c) maintaining a positive pressure of the non-oxidative gas in the interior of the shipping container during transporting to the second location; and (d) off-loading the monomer susceptible to oxidative discoloration at the second location by heating the container to above the melting temperature of the monomer and transferring it to a receiving tank under a positive pressure of a non-oxidative gas In this embodiment, the APHA of the monomer at the first location is less than 100, and the shipping container is pressurized to from about 5 to about 20 psig of the non-oxidative gas at the first location. The shipping container arrives at the second location with an interior positive pressure of from about 1 to about 20 psig of the non-oxidative gas and an oxygen ($O_2$) concentration in the shipping container at the first and second locations is from about 0.01 percent to about 10 percent. The APHA of the monomer when it arrives at the second location is less than 100 APHA.

In another embodiment, the invention provides a method for off-loading an air-sensitive monomer susceptible to discoloration from a bulk shipping container, comprising:

(a) maintaining a positive pressure of a non-oxidative gas to the interior of the bulk shipping container;

(b) adjusting the temperature of the bulk shipping container to melt the monomer;

(c) transferring the melted monomer to a receiving container under a positive pressure of the non-oxidative gas.

In a further embodiment, the invention provides a method for shipping a monomer such as 2,6-xylenol that is susceptible to oxidative discoloration in a pressurizable container, comprising:

(a) verifying that the monomer meets product specifications and has an APHA of 100 or less and preferably 50 or less;

(b) visually inspecting the interior of the container for contaminants;

(c) purging the container with nitrogen;

(d) loading the monomer into the container; and (e) sealing the container under a positive pressure of nitrogen;

In another embodiment, the invention provides a method for loading 2,6-xylenol into a bulk shipping container that minimizes the risk of discoloration due to air oxidation. This procedure comprises the following steps:

(a) checking the pressure of the container. The shipping container is pressurized with Nitrogen prior to loading to at least 5 psig. The ISO container should be checked prior to loading—if it is not pressurized, it should not be used.

(b) checking the monomer quality. Prior to commencing loading of the 2,6-xylenol, the bulk shipping container capacity and the product specifications of the 2,6 Xylenol are verified. The APHA of the 2,6-Xylenol should be less than 25 APHA. Also, the 2,6 xylenol loading line is flushed.

(c) positioning the container. This step is optional. A truck hauling an empty ISO Container equipped with a pressure gauge such as a Mortenizer gauge, thermometer, and high level capacitance probe was positioned for loading and tared. The outside of the ISO container is inspected. Grounding is installed. At this point the temperature of the ISO container should be approximately ambient.

(d) checking the $O_2$ content in container. The supply valves to the ISO container manifold are verified to be in the proper position. A nitrogen pad assembly equipped with a Mortenizer gauge is then connected to the ISO container. At this point, the ISO container pressure is verified. The ISO container is then depressurized to 0 psig by opening the Manway. A ISO container that is not pressurized to at least 5 psig should not be used. The oxygen level in the ISO container is checked during depressurization. The oxygen level should typically be 11-16 percent.

(e) optionally adding an antioxidant. At this point, a solid additive such as Ultranox 626® (about 40 pounds, or 500-1500 ppm) can be added to the container through open Manway.

(f) purging the container with nitrogen. The ISO container is then visually inspected to ensure that it is clean, dry, and free from defect. The gasket is also inspected to ensure it is properly seated. The manway cover is then installed and sealed. The vent spool piece is installed with the port for the oxygen meter facing up. The vent pipe to the atmosphere is installed. The oxygen analyzer tubing is then connected to the vent piece port. The ISO container is purged with nitrogen through the vent spool piece-vent pipe for 45 minutes (minimum) at 50 psig. The amount of time for purging can be adjusted by, for instance, monitoring the flow rate of the gas through the container; that is, with a higher flow rate, the amount of time needed for the purge process will be less.

(g) checking the $O_2$ content in the container. The ISO container vapor space percent oxygen is then checked and should be zero. The vent hose is then connected to the man way cover and the vent valve was opened. A slight continuous nitrogen purge is applied.

(h) loading the monomer. 2,6 Xylenol is then added to the desired weight by heating the 2,6-xyleonl to above its melting temperature. During loading, the tank recirculation valve is closed and the back pressure control valve is set at about 56 percent. At the end of the load, the back pressure control valve is disabled.

(i) sealing the container. After the load, the ISO container and tank should be within about 23° F. (about 12° C.) of each other. The loading arm is then blown out with nitrogen for about three minutes. The tanker vent hose is drained by lifting the vent hose low point. The final oxygen reading should be zero percent. The vent and the loading valves on the arm assembly are closed. The vent line is disconnected. The dome is closed and secured. A nitrogen pad of about 10 psig is applied. The final pressure of the container should be about 5-20 psig or to a pressure sufficient to prevent air leakage into the container as the monomer cools and solidifies.

(j) The loaded container is checked for leaking. The manway and vent valve are checked for leaks and then the container is weighed.

Loading 2,6-Xylenol to a Shipping Container

In one embodiment, a typical procedure for loading a shipping container with 2,6-xylenol according to the method described herein is as follows and begins with verification that the 2,6-xylenol meets product specifications. The purity of the 2,6 xylenol is typically greater than 99.0 percent. Preferably, the purity of the 2,6-xylenol is greater than 99.8 percent and contains no more than 0.5% maximum percent of water and no more that 0.16 percent by weight of other aromatic components, which may include other phenols and cresols. Typically, the APHA color number is no more than 100, and preferably the APHA color number is no more than 75. More preferably, the APHA color number is no more than 50. Most preferably, the APHA color number is no more than 25.

Next, the tanker that will be used is inspected and the tanker capacity is confirmed. The tanker is positioned for loading, and grounding is installed. The tanker thermometer and the high level probe are inspected for operability. The loading platform is then lowered to the tanker until it rests firmly in place. The pressure is then slowly released from the tanker by loosening the dome wing-nuts. If there is no pressure released from the tanker, the tanker is rejected for not being capable of maintaining a positive pressure. Upon the release of the tanker pressure, the dome is opened and visually inspected, the dome gasket and all ports of entry in and out of the tanker, including cleaning ports. A solid additive such as an antioxidant can optionally be added to the tanker at this point. For example Ultranox 626® (40 pounds) is introduced to the container through the Manway.

The loading arm assembly is then lowered into place over the dome and secured with 2 wing-nuts. The hatch seal is inspected for punctures and safety lines are attached. The inflatable hatch seal is then inflated with nitrogen to 5 psig. The vent arm is then connected to hatch seal. The vent and loading valves are then opened. The container is then purged with Nitrogen for a sufficient time to replace the ambient atmosphere inside the tanker with nitrogen. The oxygen content inside the tanker can be checked with a detector that is attachable to the tanker. When the detector gives a "zero" oxygen reading, it is ready for loading.

2,6-Xylenol is loaded into the blend tank, and then into the tanker via the arm assembly. After the addition is complete, the loading arm is flushed with nitrogen for at least one to three minutes to collect any residual 2,6-xylenol in the tanker. The vent and valves on the arm assembly are then closed, the inflatable hatch seal is deflated, and the vent line is disconnected. The arm is lifted away from the tanker and secured, and the dome is closed and tightened under a positive pressure of nitrogen so that the nitrogen pressure inside the tank is preferably at least 10 psig.

After loading and storage, the purity of the 2,6 xylenol is typically greater than 98.0 percent. Preferably, the purity of the 2,6-xylenol is greater than 99.8 percent, and more preferably the purity is greater than 99 percent. Typically, the APHA color number is no more than 100, and preferably the APHA color number is no more than 75. More preferably, the APHA color number is no more than 50. Most preferably, the APHA color number is no more than 25.

Another embodiment for loading 2,6-xylenol into a bulk shipping container that minimizes the risk of discoloration due to air oxidation comprises the following steps.

A truck hauling an empty ISO container equipped with a pressure gauge such as a Mortenizer gauge, thermometer, and high level capacitance probe is positioned for loading and tared. The outside of the ISO container is inspected, and grounding is installed. At this point, the temperature of the ISO container is approximately ambient.

The shipping container is pressure checked to ensure that is can maintain a positive pressure. The shipping container is pressurized with Nitrogen prior to loading to at least 5 psig. If the container cannot be pressurized, it should not be used.

Next, the product specifications of the 2,6-xylenol are checked. The APHA of the 2,6-Xylenol should be no more than 50 APHA, and preferably, should be less than 25 APHA.

The supply valves to the ISO container manifold are then verified to be in the proper position. A nitrogen pad assembly equipped with a Mortenizer gauge is then connected to the ISO container. At this point, the ISO Container pressure is verified. The ISO container is then depressurized to 0 psig by opening the Manway. A ISO container that is not pressurized to at least 5 psig should not be used. The oxygen level in the ISO container is checked during depressurization. The oxygen level should typically be 11-16 percent.

At this point, a solid additive such as Ultranox 626® (about 40 lbs, or 500-1500 ppm relative to the monomer) optionally can be added to the container through the open Manway.

The container is then purged with nitrogen through the vent spool piece-vent pipe for 45 minutes (minimum) at 50 psig dead head to flush the oxygen from the container. The time for purging the container may be less as indicated previously, depending on the flow rate of gas through the container. The ISO container vapor space percent oxygen should be zero. The vent hose is then connected to the manway cover and the vent valve was opened. A slight continuous nitrogen purge is applied. The regulator is set at 2 to 8 psig dead head, and the 2,6-xylenol is added at a temperature above the melting point, or typically about from 50° C. to 85° C. During loading, the tank recirculation valve is closed and the back pressure control valve is set at about 56 percent. At the end of the load, the back pressure control valve is disabled.

After loading is completed, the container is sealed. The container and tank should be within about 23° F. (about 12° C.) of each other. The loading arm is then blown out with nitrogen for about three minutes. The tanker vent line is drained by lifting the vent hose low point. The final oxygen reading should be zero percent. The vent and the loading valves on the arm assembly are closed. The vent line is disconnected. The dome is closed and secured. A nitrogen pad of about 10 psig is applied. Regulated pressure was used to prevent over-pressurizing.

The final pressure of the container should be about 5 to 20 psig, and more preferably about 8-15 psig, and more preferably, about 10 psig. The pressure should be such that as the monomer cools and solidifies, there is sufficient positive nitrogen pressure in the tank to prevent air from leaking in.

The manway and vent valve are checked for leaks and the loaded container is then weighed.

After loading and storage, the purity of the 2,6 xylenol is typically greater than 98.0 percent. Preferably, the purity of the 2,6-xylenol is greater than 99.8 percent, and more preferably the purity is greater than 99 percent. Typically, the APHA color number is no more than 100, and preferably the APHA color number is no more than 75. More preferably, the APHA color number is no more than 50. Most preferably, the APHA color number is no more than 25.

Offloading 2,6-Xylenol from a Shipping Container

Another embodiment provides a typical procedure for offloading 2,6-xylenol from a shipping container to a receiving tank.

A steam line is connected to a shipping container that is loaded with 2,6-xylenol and that is equipped with a thermometer and pressure measuring device using external steam channels. The tanker is steam heated at a steam pressure of about 0.2 Mpa (29 psig). During heating, the outlet of the steam channels on the container are kept open. The container is heated to a temperature sufficient to melt the 2,6-xylenol, of from between about 60° C. to about 90° C.

After about 30 hours, heating is stopped. The container is allowed to sit for several hours. At this point, if the temperature drop is less than 2° C. in 2 hours, the 2,6 xylenol inside the container should be completely melted. If the temperature drop is more than 2° C. in 2 hours, there may be some congelation of the 2,6 Xylenol inside the container, and steam heating is resumed.

The flange of the receiving tank is then connected to the bottom outlet of container. The nitrogen line of the receiving tank is connected to the vapor return line of the container.

Next, approximately 200 kg of 2.6 Xylenol is flowed into the receiving tank and removed through the receiving tank outlet The APHA value of this 200-300 g sample of 2.6 Xylenol is evaluated. The purity of the 2,6 xylenol is typically greater than 98.0 percent. Preferably, the purity of the 2,6-xylenol is greater than 99.8 percent, and more preferably the purity is greater than 99 percent. Typically, the APHA color number is no more than 100, and preferably the APHA color number is no more than 75. More preferably, the APHA color number is no more than 50. Most preferably, the APHA color number is no more than 25.

In another embodiment, the invention provides a container suitable for shipping a monomer that is susceptible to discoloration such as described herein, comprising a pressurized interior and an optional pressure gauge and oxygen detector. The interior of the container is pressurized as described herein to a pressure of about 5 to about 20 psig with a non-oxidative gas such as nitrogen or as described herein, and further comprises a monomer susceptible to oxidative discoloration and an optional antioxidant. Typically, the monomer is 2,6-xylenol. The container is further optionally jacketed so that the interior compartment of the container is separated from the exterior wall of the container by a space, thus creating a container within the container. The jacket component of the container is equipped with inlet and outlet valves to facilitate heating with, for instance steam or hot water or the like, or cooling with chilled water or brine or the like.

The following non-limiting examples are provided to illustrate the invention.

EXAMPLES

Example 1

Color Stability of 2,6-Xylenol Under Simulated 2,6-Xylenol is a solid at ambient temperature. In order to expedite the bulk loading process, it is heated to above its melting point of 43-45° C., until it is a sufficiently free-flowing liquid to ensure ease of transfer to a bulk container.

During transfer to a shipping container in an ambient atmosphere that contains oxygen, 2,6-Xylenol, which is typically colorless, tends to discolor due to oxidative dimerization to form 2,2,6,6-tetramethyl bisphenol and 2,2,6,6-tetramethyl diquinone, both of which are yellow in color.

The color stability of 2,6-xylenol was analyzed under simulated bulk transfer/shipping conditions using the APHA color scale by comparison to stock standard solutions having known APHA values.

Stock Standard Preparation.

Potassium chloroplatinate (1.246 g) and cobaltous chloride (1.0 g) were added to a clean plastic bottle containing 100 mL of distilled water and 1 mL concentrated hydrochloric acid. The mixture was stirred until the solids dissolved. The solution was transferred to a 1 L flask and diluted to 1 L with distilled water to give the Stock Standard.

Stock Standard Solution Preparation.

Distilled water (50 mL) was added to a clean 50 mL Nessler tube. This tube was labeled "APHA 0" (blank).

Stock Standard (1 mL) was added to a 50 mL Nessler tube and was diluted to 50 mL with distilled water. This tube was labeled "APHA 10".

This process was repeated using 2, 5, 10, 20, 30, and 40 mL of Stock Standard to give, upon dilution to 50 mL, 6 additional Nessler tubes containing stock standard solutions, labeled "20 APHA", "50 APHA", "100 APHA", "200 APHA", "300 APHA", and "400 APHA", respectively.

The stock standard solutions are progressively yellow in color, such that "0 APHA" is colorless and "400 APHA" has the strongest yellow color.

Sample Analysis

Samples of 2,6-xylenol were placed in open flasks and heated to 80° C. The color stabilities of the samples were measured on the APHA color scale by visual comparison of the samples to the stock standard solutions, by looking down through the tops of the samples and standards. The lesser APHA color number was assigned if the color was found to be between two standard colors. The results are recorded in Table 1 and indicate that the APHA color number of the samples increased (that is, become more yellow in color) as the samples were heated in the open flasks exposed to air.

TABLE 1

Color Stability of 2,6-Xylenol in Air at 80° C.

| | APHA | | | | | |
|---|---|---|---|---|---|---|
| Sample | 0 hrs | after 12 hrs | after 19 hrs | after 36 hrs | after 43 hrs | after 67 hrs |
| 1 | 48 | — | 1061 | 1613 | — | 1896 |
| 2 | 82 | — | 122 | 195 | — | 293 |
| 3 | 57 | 718 | — | — | 1723 | — |

Example 2

Color Stability of 2,6 Xylenol under Nitrogen at 80° C., Optionally in the Presence of an Antioxidant The Example 1 procedure was repeated, with the following modifications:

a) some 2,6-xylenol samples were treated with the antioxidant Ultranox 626®;

b) some 2,6-xylenol samples were placed under a blanket of an nitrogen using a nitrogen bleed tube placed immediately above the surface of the melted monomer (i.e., were "rinsed" or "flushed" with nitrogen); and c) nitrogen was bubbled through some of the liquefied samples of 2,6-xylenol The results are summarized in Tables 2-4. Table 2 provides the color stability of the samples where the antioxidant Ultranox 626® was added. Table 2 indicates that samples treated with Ultranox 626® had lower APHA color numbers (were less yellow in color) than samples that did not contain the antioxidant. The results indicate that 2,6-xylenol samples that were heated in the presence of Ultranox 626® maintained their color stability better than samples that did not contain the antioxidant.

TABLE 2

Color Stability of 2,6-Xylenol in the Presence of Ultranox at 80° C. (APHA Color).

| Time (hrs) | No Ultranox 626 | 250 ppm Ultranox 626 | 500 ppm Ultranox 626 |
|---|---|---|---|
| 0 | 14 | 14 | 14 |
| 24 | 19 | 14 | 11 |
| 48 | 31 | 15 | 12 |
| 72 | 47 | 12 | 9 |
| 96 | 64 | 13 | 12 |

Tables 3 and 4 compare the color stability of samples of 2,6-xylenol heated to 80° C. in air as compared to samples flushed with nitrogen, and optionally, further containing Ultranox 626® as an additive. In each case, 2,6-xylenol was placed in a flask and then heated to 80° C. so that the 2,6-xylenol melted. Nitrogen was flowed through the flask using a bleed tube attached to a nitrogen tank so that the blanket of nitrogen formed immediately above the surface of the melted 2,6-xylenol. Results were recorded for a nitrogen flush alone and in combination with Ultranox 626®. The results indicate a lower change in APHA when a nitrogen flush was used alone or in combination with Ultranox 626® as compared to the sample in air. Tables 3 and 4 indicate that a nitrogen flush alone will minimize discoloration of the 2,6-xylenol.

TABLE 3

Color Stability of 2,6-Xylenol with Nitrogen Flush at 80° C. APHA Color

| Conditions | Ultranox 626 | after 0 hr | 10 hrs | 25 hrs | 34 hrs | 49 hrs | 58 hrs | 73 hrs | 81 | 96 | 110 | 125 |
|---|---|---|---|---|---|---|---|---|---|---|---|---|
| In Air | 1000 ppm | 11 | — | 48 | — | 121 | — | 208 | — | 296 | — | — |
| Nitrogen Flush | 1000 ppm | 11 | 13 | — | 15 | — | 13-11 | — | 14 | — | 22 | — |
| Nitrogen Flush | 0 ppm | 10 | — | 9 | — | 7 | — | 17 | — | 18 | — | 275/273 |

TABLE 4

| Color Stability of 2,6-Xylenol with Nitrogen Flush at 80° C. (APHA Color). | | | |
|---|---|---|---|
| Conditions | Ultranox 626 | after 0 hr | 30 hrs |
| Flask flushed with nitrogen | 1000 ppm | 7 | 24 |
| Flask flushed with nitrogen | 0 ppm | 7 | 58 |

Table 5 compares the effect of nitrogen bubbling versus nitrogen rinsing or flushing on the color stability of 2,6-xylenol, optionally in the presence of Ultranox 626®. 2,6-Xylenol was added to a flask and heated to 80° C. so that the 2,6-xylenol melted. Nitrogen was either purged above (rinsed or flushed) or bubbled through the melted 2,6-xylenol during the course of the experiment using a bleed tube. Results were recorded for samples using nitrogen bubbling alone and in combination with Ultranox 626®.

The results in Table 5 generally show a lower change in APHA color number when nitrogen bubbling was employed instead of a nitrogen flush.

Test 1 of Table 5 indicates that nitrogen bubbling through the melted 2,6-xylenol lead to greater color stability than addition of the antioxidant without nitrogen bubbling.

Tests 2, 3, and 4 of Table 5 indicates that nitrogen rinsing did not work as well as nitrogen bubbling in minimizing monomer discoloration.

TABLE 5

| Color Stability of 2,6-Xylenol With Nitrogen Flush at 80° C. | | | | | | | | | |
|---|---|---|---|---|---|---|---|---|---|
| Test (1) $N_2$ continuous bubbling through liquid at 80° C. APHA Color vs. ageing time at 80° C.; continuous $N_2$ bubbling through liquid | | | | | | | | | |
| Time- hrs from start | 0 | 10 | 25 | 34 | 49 | 58 | 73 | 81 | 96 |
| No Ultranox addition - $N_2$ bubbling | 10 | — | 9 | — | 7 | — | 17 | — | 18 |
| 1000 ppm Ultranox addition- $N_2$ bubbling | 11 | 13 | — | 15 | — | 12 | — | 14 | — |
| 1000 ppm Ultranox addition - air reference | 11 | — | 48 | — | 121 | — | 208 | — | 296 |
| Test (2) APHA Color vs. ageing time at 80° C.; $N_2$ rinse of flask before filling; $N_2$ rinse after each sampling for APHA color measurement | | | | | | | | | |
| Time- hrs from start | 0 | 29 | 73 | — | — | — | — | — | — |
| No Ultranox addition - $N_2$ rinse | 18 | 274 | 545 | — | — | — | — | — | — |
| 1000 ppm Ultranox addition - $N_2$ rinse | 14 | 22 | 45 | — | — | — | — | — | — |
| Test (3) APHA Color vs. ageing time at 80° C.; $N_2$ rinse of flask before filling, $N_2$ rinse after each sampling for APHA color measurement | | | | | | | | | |
| Time- hrs from start | 0 | 30 | 73 | — | — | — | — | — | — |
| No Ultranox addition - $N_2$ rinse | 7 | 58 | 396 | — | — | — | — | — | — |
| 1000 ppm Ultranox addition- $N_2$ rinse | 7 | 24 | 73 | — | — | — | — | — | — |

TABLE 5-continued

| Color Stability of 2,6-Xylenol With Nitrogen Flush at 80° C. | | | | | | | | |
|---|---|---|---|---|---|---|---|---|
| Test (4) APHA Color vs. ageing time at 80° C.; $N_2$ rinse of flask before filling; $N_2$ rinse after each sampling for APHA color | | | | | | | | |
| Time- hrs from start | 0 | 19 | 43 | 67 | 91 | 163 | 187 | 235 |
| No Ultranox addition - $N_2$ rinse | 7 | 13 | 28 | 36 | 45 | 70 | 87 | 670 |
| 1000 ppm Ultranox addition - $N_2$ rinse | 7 | 7 | 11 | 8 | 7 | 7 | 8 | e7 |

Example 3

Pressure and Temperature Tracking of ISO Containers Loaded with 2,6-Xylenol

An ISO shipping container loaded with 2,6 xylenol under a positive pressure of nitrogen was analyzed for changes in pressure and temperature following completion of the 2,6-xylenol loading process. Results are summarized in Table 6. The results indicate that as the 2,6-xylenol cools and solidifies, the pressure drops.

TABLE 6

| Pressure and Temperature tracking of ISO Containers Loaded with 2,6-Xylenol. | | | | | |
|---|---|---|---|---|---|
| | First Run | | Second Run | | |
| Day | Pressure (psig) | Temp (F.) | Press (psig) | Temp (F.) | Remarks |
| 1 | 0 | 50 | 0 | 50 | Initial reading before charging |
| | 10 | 155 | 10 | 155 | Readings after charging |
| 2 | 5 | 59° C./ 138 | 6 | 59° C./ 138° 5 | |
| 3 | 3 | 50° C./ 122 | 4 | 50° C./ 122° F. | |
| 4 | 1/10 | 115 | 2/10 | 115 | $N_2$ Topped off to 10 psig |
| 5 | 8 | 110 | 9 | 110 | |
| 6 | 5 | 105 | 6 | 105 | |
| 7 | 3 | 101 | 4 | 100 | |
| 8 | 2/10 | 96 | 3/10 | 95 | $N_2$ Topped off to 10 psig |
| 9 | 8 | 91 | 8 | 90 | |
| 10 | 5 | 86 | 6 | 85 | Cold & Windy |
| 11 | 2.5 | 81 | 3.5 | 79 | Very Cold (5 F.) & Windy |
| 12 | 1.5/10 | 79 | 2/10 | 76 | $N_2$ Topped off to 10 psig |
| 13 | 10 | 75 | 10 | 75 | |
| 14 | 7 | 74 | 7 | 74 | |
| 15 | 6 | 73 | 7 | 71 | |
| 18 | 4 | 70 | 5 | 67 | |
| 19 | 4 | 69 | 5 | 66 | |
| 20 | 3 | 68 | 4 | 65 | |
| 21 | 3/10 | 67 | 4/10 | 64 | $N_2$ Topped off to 10 psig before leaving site |

The invention includes at least the following embodiments.

Embodiment 1. A method for bulk transporting a monomer susceptible to oxidative discoloration, comprising:

(a) loading the monomer to a bulk shipping container; and (b) sealing the bulk shipping container loaded with the monomer under a positive pressure of the non-oxidative gas.

Embodiment 2. The method of Embodiment 1, wherein the monomer comprises 2,6-xylenol.

Embodiment 3. The method of Embodiments 1-2, wherein the bulk shipping container is a container designed for intermodal transportation of monomers susceptible to oxidative discoloration.

Embodiment 4. The method of Embodiments 1-3, wherein the bulk shipping container is equipped with a pressure monitoring device.

Embodiment 5. The method of claim Embodiments 1-4, wherein the non-oxidative gas of step (a) is selected from the group consisting of nitrogen, helium, neon, and argon, or mixtures thereof.

Embodiment 6. The method of Embodiments 1-5, wherein the non-oxidative gas of step (a) is nitrogen or argon, or mixtures thereof.

Embodiment 7. The method of Embodiments 1-6, further comprising the step of purging the bulk shipping container with a non-oxidative gas prior to loading the monomer.

Embodiment 8. The method of Embodiments 1-7, wherein the oxygen concentration prior to loading the monomer in the container interior is between about 0.01 percent and 10 percent.

Embodiment 9. The method of Embodiments 1-8, wherein a positive pressure of the non-oxidative gas is maintained in the shipping container during loading.

Embodiment 10. The method of Embodiments 1-9, wherein an antioxidant is optionally added to the bulk shipping container.

Embodiment 11. The method of Embodiments 1-10, wherein the antioxidant comprises an organophosphite antioxidant.

Embodiment 12. The method of Embodiments 1-11, wherein the antioxidant comprises bis (2,4-di-t-butylphenyl) pentraerythritol diphosphite antioxidant.

Embodiment 13. The method of claim Embodiments 1-12, wherein the monomer is loaded into the bulk shipping container at a temperature that is above the melting temperature of the monomer susceptible to discoloration.

Embodiment 14. The method of Embodiments 1-13, wherein the temperature is between about 50 and 100° C.

Embodiment 15. The method of Embodiments 1-14, wherein the temperature is between about 60 and 90° C.

Embodiment 16. The method of Embodiments 1-15, wherein the bulk shipping container loaded with the monomer is pressurized with the non-oxidative gas prior to sealing, to produce a positive pressure of about 1 to about 20 psig of the non-oxidative gas.

Embodiment 17. The method of Embodiments 1-16 that minimizes formation of colored degradation products.

Embodiment 18. The method of Embodiments 1-17 that limits discoloration of the monomer.

Embodiment 19. The method of Embodiments 1-18, wherein the initial APHA of the monomer is 75.

Embodiment 20. The method of Embodiments 1-18, wherein the initial APHA of the monomer is 50.

Embodiment 21. The method of Embodiments 1-18, wherein the initial APHA of the monomer is 25.

Embodiment 22. The method of Embodiments 1-21, wherein the change in APHA compared to the initial APHA of the monomer after loading and off-loading the container is less than 100.

Embodiment 23. A method for off-loading an air-sensitive monomer susceptible to discoloration from a bulk shipping container, comprising:

(a) providing a positive pressure of an inert gas to the interior of the bulk shipping container;

(b) adjusting the temperature of the bulk shipping container to maintain the flowability of the monomer; and (c) transferring the monomer to a receiving container under a positive pressure of the non-oxidative gas.

Embodiment 24. The method of Embodiment 23, wherein the monomer comprises 2,6-xylenol Embodiment 25. The method of Embodiments 23-24, wherein the 2,6-xylenol is off-loaded from the bulk shipping container to the receiving container at a temperature that is greater than the melting temperature of 2,6-xylenol.

Embodiment 26. The method of Embodiments 23-25, wherein the 2,6-xylenol is off-loaded at a temperature of from about 50-90° C.

Embodiment 27. The method of Embodiments 23-26, wherein a positive pressure of the non-oxidative gas is maintained in the shipping container during loading.

Embodiment 28. A container with an interior that is pressurized with a non-oxidative gas that contains a monomer susceptible to oxidative discoloration and an optional antioxidant.

Embodiment 29. The container of Embodiment 28, wherein the non-oxidative gas is selected from the group consisting of argon, neon, and nitrogen, or mixtures thereof.

Embodiment 30. The container of Embodiments 28-29, wherein the inert gas is nitrogen.

Embodiment 31. The container of Embodiments 28-30, wherein the positive pressure in the interior is 5-20 psig nitrogen.

Embodiment 32. The container of Embodiments 28-31, further comprising a pressure gauge and an oxygen gas ($O_2$) detector.

Embodiment 33. The container of Embodiments 28-32, further comprising a pressure gauge and an oxygen gas ($O_2$) detector.

Embodiment 34. The container of Embodiments 28-33, wherein the monomer comprises 2,6-xylenol.

Embodiment 35. A method for bulk transporting a monomer susceptible to oxidative discoloration from a first to a second location, comprising:

(a) loading the monomer to the interior of a bulk shipping container;

(b) sealing the bulk shipping container loaded with the monomer under a positive pressure of the non-oxidative gas and then transporting the bulk shipping container;

(c) maintaining a positive pressure of the non-oxidative gas in the interior compartment of the shipping container during transporting to the second location; and (d) off-loading the monomer susceptible to oxidative discoloration at the second location to a receiving tank under a positive pressure of a non-oxidative gas.

Embodiment 36. The method of Embodiment 35, wherein the monomer comprises 2,6-xyleonl.

Embodiment 37. The method of Embodiments 35-36, further comprising heating the monomer to above its melting temperature prior to step (a) and step (d).

Embodiment 38. The method of Embodiments 35-37, wherein a positive pressure of the non-oxidative gas is maintained in the shipping container during loading.

Embodiment 39. The method of Embodiments 35-38, wherein the non-oxidative gas is nitrogen optionally admixed with argon.

Embodiment 40. The method of Embodiments 35-39, wherein the optional antioxidant is an organophosphate antioxidant.

Embodiment 41. The method of Embodiments 35-40, wherein the optional antioxidant is Ultranox® 626.

Embodiment 42. The method of Embodiments 35-41, wherein the APHA of the monomer at the first location is less than 100.

Embodiment 43. The method of Embodiments 35-42, wherein the shipping container is pressurized to from about 5 to about 20 psig of the non-oxidative gas at the first location.

Embodiment 44. The method of Embodiments 35-43, wherein the shipping container arrives at the second location with an interior positive pressure of from above 0 to about 20 psig Embodiment 45. The method of Embodiments 35-44, wherein the oxygen ($O_2$) concentration in the shipping container at the first and second locations is from about 0.01 percent to about 10 percent.

Embodiment 46. The method of Embodiments 35-45, wherein the APHA of the monomer at the first location is less than 100 and the APHA of the monomer at the second location is less than 100 APHA.

Embodiment 47. A method for off-loading an air-sensitive monomer susceptible to discoloration from a bulk shipping container, comprising:

(a) maintaining a positive pressure of an inert gas to the interior of the bulk shipping container;

(b) adjusting the temperature of the bulk shipping container to melt the monomer; and (c) transferring the melted monomer to a receiving container under a positive pressure of the non-oxidative gas.

The foregoing invention has been described in some detail by way of illustration and example, for purposes of clarity and understanding. The invention has been described with reference to various specific embodiments and techniques. However, it should be understood that many variations and modifications may be made while remaining within the spirit and scope of the invention. It will be obvious to one of skill in the art that changes and modifications may be practiced within the scope of the appended claims. Therefore, it is to be understood that the above description is intended to be illustrative and not restrictive. The scope of the invention should, therefore, be determined not with reference to the above description, but should instead be determined with reference to the following appended claims, along with the full scope of equivalents to which such claims are entitled. All patents, patent applications and publications cited in this application are hereby incorporated by reference in their entirety for all purposes to the same extent as if each individual patent, patent application or publication were so individually denoted.

The invention claimed is:

1. A method for bulk transporting 2,6-xylenol, comprising:

(a) loading 2,6-xylenol into a bulk shipping container that conforms to International Organization for Standardization (ISO) specifications for the shipment of chemicals susceptible to oxidative discoloration, wherein the bulk shipping container is purged with a non-oxidative gas prior to loading of the 2,6-xylenol to replace the air/oxygen from the bulk shipping container with the non-oxidative gas; wherein the oxygen ($O_2$) concentration after loading the 2,6-xylenol in the bulk shipping container interior is between about 0.01 percent and 10 percent; and (b) sealing the bulk shipping container loaded with 2,6-xylenol under a positive pressure of the non-oxidative gas;

wherein the APHA yellow color index of the 2,6-xylenol is maintained at 100 APHA or less.

2. The method of claim 1, wherein the bulk shipping container is equipped with a pressure monitoring device.

3. The method of claim 1, wherein the non-oxidative gas is selected from the group consisting of nitrogen, helium, neon, and argon, or mixtures thereof.

4. The method of claim 1, wherein the non-oxidative gas is nitrogen or argon, or mixtures thereof.

5. The method of claim 1, wherein a positive pressure of the non-oxidative gas is maintained in the shipping container during loading.

6. The method of claim 1, wherein an antioxidant is optionally added to the bulk shipping container.

7. The method of claim 6, wherein the antioxidant comprises an organophosphate antioxidant.

8. The method of claim 7, wherein the antioxidant comprises bis (2,4-di-t-butylphenyl)pentraerythritol diphosphite.

9. The method of claim 1, wherein the 2,6-xylenol loaded into the bulk shipping container at a temperature that is above the melting temperature of the 2,6-xylenol susceptible to discoloration.

10. The method of claim 9, wherein the temperature is between about 50 and 100° C.

11. The method of claim 9, wherein the temperature is between about 60 and 90° C.

12. The method of claim 1, wherein the bulk shipping container loaded with the 2,6-xylenol is pressurized with the non-oxidative gas prior to sealing, to produce a positive pressure of about 1 to about 20 psig of the non-oxidative gas.

13. The method of claim 1 that minimizes formation of colored degradation products.

14. The method of claim 1 that limits discoloration of the 2,6-xylenol.

15. The method of claim 1, wherein the initial APHA of the 2,6-xylenol is 75.

16. The method of claim 1, wherein the initial APHA of the 2,6-xylenol is 50.

17. The method of claim 16, wherein the change in APHA compared to the initial APHA of the 2,6-xylenol after loading and off-loading the container is less than 100.

18. The method of claim 1, wherein the initial APHA of the 2,6-xylenol is 25.

19. A method for bulk transporting 2,6-xylenol susceptible to oxidative discoloration from a first to a second location, comprising:

(a) loading 2,6-xylenol into the interior of a bulk shipping container that conforms to International Organization for Standardization (ISO) specifications for the shipment of chemicals susceptible to oxidative discoloration, wherein the bulk shipping container is purged with a non-oxidative gas prior to loading of the 2,6-xylenol to replace the air/oxygen from the bulk shipping container with the non-oxidative gas; wherein the oxygen ($O_2$) concentration after loading the 2,6-xylenol in the bulk shipping container interior is between about 0.01 percent and 10 percent, and wherein an antioxidant is added to the bulk shipping container prior to loading the 2,6-xylenol;

(b) sealing the bulk shipping container loaded with 2,6-xylenol under a positive pressure of the non-oxidative gas and then transporting the bulk shipping container;

(c) maintaining a positive pressure of the non-oxidative gas in the interior compartment of the shipping container during transporting to the second location; and (d) off-loading 2,6-xylenol susceptible to oxidative discoloration at the second location to a receiving tank under a positive pressure of the non-oxidative gas.

20. The method of claim 19, further comprising heating 2,6-xylenol to above its melting temperature prior to step (a) and step (d).

21. The method of claim 19, wherein a positive pressure of the non-oxidative gas is maintained in the bulk shipping container during loading.

22. The method of claim 19, wherein the non-oxidative gas is nitrogen optionally admixed with argon.

23. The method of claim 19, wherein the antioxidant is an organophosphate antioxidant.

24. The method of claim 19, wherein the antioxidant is bis (2,4-di-t-butyphenyl)penetraerythritol diphosphite.

25. The method of claim 19, wherein the APHA of 2,6-xylenol at the first location is less than 100.

26. The method of claim 19, wherein the bulk shipping container is pressurized to from about 5 to about 20 psig of the non-oxidative gas at the first location.

27. The method of claim 19, wherein the bulk shipping container arrives at the second location with an interior positive pressure of from above 0 to about 20 psig.

28. The method of claim 19, wherein the oxygen ($O_2$) concentration in the shipping container at the first and second locations is from about 0.01 percent to about 10 percent.

29. The method of claim 19, wherein the APHA of 2,6-xylenol at the first location is less than 100 and the APHA of 2,6-xylenol at the second location is less than 100 APHA.

* * * * *